US005527078A

United States Patent [19]

Messick

[11] Patent Number: 5,527,078

[45] Date of Patent: Jun. 18, 1996

[54] CORE LIFT

[76] Inventor: William H. Messick, 1902 Hickory Blvd., SE., Apt. H-8, Lenoir, N.C. 28645

[21] Appl. No.: 339,359

[22] Filed: Nov. 14, 1994

[51] Int. Cl.[6] ..... B66C 1/54

[52] U.S. Cl. ..... 294/95; 414/911

[58] Field of Search ..... 294/93–97, 86.24, 294/86.25, 116; 414/910, 911

[56] References Cited

U.S. PATENT DOCUMENTS

| | | | |
|---|---|---|---|
| 621,380 | 3/1899 | Shoffner . | |
| 1,445,581 | 2/1923 | Fullop . | |
| 1,495,409 | 5/1924 | Foster . | |
| 1,540,566 | 6/1925 | Petree . | |
| 2,020,561 | 11/1935 | McCullough | 294/96 |
| 2,614,881 | 10/1952 | Holland | 294/86 |
| 3,075,800 | 1/1963 | Rowekamp | 294/95 |
| 3,163,338 | 12/1964 | Hayes | 166/214 |
| 4,340,249 | 7/1982 | Bucklew | 294/95 |
| 4,577,899 | 3/1986 | Hemingway | 294/95 |
| 4,687,244 | 8/1987 | Cullen et al. | 294/86.41 |
| 4,919,881 | 4/1990 | Hankinson et al. | 294/86.25 |
| 4,997,225 | 3/1991 | Denis | 294/86.25 |

*Primary Examiner*—Dean Kramer
*Attorney, Agent, or Firm*—Richard E. Jenkins

[57] ABSTRACT

An apparatus for lifting and reorienting an object having an internally accessible axially extending opening, such as a pipe or a roll of plastic. The apparatus has an elongated shaft and a tapered probe attached at the lower portion thereof. A plurality of gripping members or dogs are provided for engaging the inside surface of the internal opening of the object with a force corresponding to the weight of the object so that the apparatus may be employed for lifting and reorienting the object.

11 Claims, 4 Drawing Sheets

CORE LIFT

TECHNICAL FIELD

The present invention relates generally to an apparatus for lifting and reorienting an object having an internally accessible axial opening. More particularly, the present invention relates to such an apparatus for lifting and reorienting such objects that are very heavy, i.e. a long ton (2240 pounds avoirdupois) or more in weight.

BACKGROUND OF THE INVENTION

Various products are made and then stored on hollow rolls. (By rolls, it is intended to include other similar items, such as reels, spools, and the like.) The size and/or weight of these products can make them unmanageable when it is desired to move them, such as for loading onto a truck to deliver them to a customer or for placing on a shelf to store them in inventory. Examples of such products are rolls of paper, plastic, fabric, wire, sheet metal, newsprint, and bales of hay.

A number of apparatus, many with retractable gripping members, have been designed to be inserted into the opening in the roll, reel, spool, and the like in order to maneuver these products. In effect, these apparatus allow the lifting and reorienting of anything having a central aperture, further examples being well casings and pipe tubing. The apparatus are colloquially known as core lifting apparatus.

For instance, U.S. Pat. No. 4,687,244, issued in 1987 to Cullen et al., shows a lift and reorienting apparatus for moving items having a central aperture, such as well casings and rolls of sheet metal. Projections 18 are the retractable gripping members in the apparatus. Also, the apparatus has a sleeve shoulder 34 for preventing it from going further into the central aperture than desired.

U.S. Pat. No. 621,380, issued in 1899 to Shoffner, shows a device for raising bailless buckets from wells. The device consists of a spirally-constructed dart which has arms pivoted thereto and which is adapted to be sunk into a well and withdrawn by means of a cord. Arms 8, 11 are the retractable gripping members of the device. U.S. Pat. No. 1,445,581, issued in 1923 to Fullop, shows a tool for removing well casings and the like. The tool has a pipe gripping section detachably associated with a supporting section, and both of the sections are hollow and arranged to house the controlling connections for the gripping members. Dogs 4 are the gripping members in the tool.

U.S. Pat. No. 1,495,409, issued in 1924 to Foster, shows a fishing tool consisting essentially of a tube suspended by a bail and having in its side walls a plurality of loosely fitting dogs, which are adapted to fall into contact with the rod or casing to be withdrawn during the lowering of the fishing tool into a well. Dogs 15 are the retractable gripping members in the tool. U.S. Pat. No. 1,540,566, issued in 1925 to Petree, shows a pipe extractor for removing pipes from wells. The extractor has a body portion and a shank portion. The body portion is larger than the shank portion, which is threaded at its upper end and forms a point at its bottom end. Dogs 17 are the retractable gripping members in the pipe extractor.

U.S. Pat. No. 2,020,561, issued in 1935 to McCullough, shows a spear and releasable hammer for use in oil or water wells, for movement of a pipe or casing. The pipe or casing engaging member is part of the jar, and the jarring action is imparted to the gripping member and then to the pipe or casing. Slips 14 are the retractable gripping members in the spear and releasable hammer. Additionally, U.S. Pat. No. 2,614,881, issued in 1952 to Holland, shows a well fishing tool for engaging a body such as a pipe lost in the well, and raising the pipe from the well. The fishing tool has at least one automatically operated gripping tongue for engaging the pipe. Thus, tongues 20 in the fishing tool are the retractable gripping members.

Of lesser interest is U.S. Pat. No. 3,163,228, issued in 1964 to Hayes. This patent shows a cable latching device for guiding and aligning equipment under water to a predetermined base, such as an offshore well which has been drilled and completed at a point adjacent the ocean floor. Dogs. 46, 47, are the retractable gripping members in the cable latching device. Also of lesser interest, U.S. Pat. No. 4,577,899, issued in 1986 to Hemingway, shows an apparatus for removing a liner cup from a golf hole. Wedges 9 are the retractable gripping members in the liner cup remover apparatus.

SUMMARY AND OBJECTS OF THE INVENTION

Therefore, the present invention provides an apparatus for lifting and reorienting an object having an internally accessible axially extending opening defining an inner surface thereof. The apparatus comprises a generally elongated shaft having an upper portion and a lower portion. Also, the apparatus comprises a generally tapered probe fixedly attached at the lower end of the shaft. The probe has (i) a top end, a bottom end, and a center, and (ii) a generally conical-shaped recess disposed within the top end of the probe. The conical recess has a top and a bottom, and the conical surface thereof serves as a bearing surface.

Additionally, the apparatus comprises a first sleeve assembly mounted on the upper portion of the shaft, for relative axial slidable movement between an uppermost position and a lowermost position along the shaft. The first sleeve assembly has (i) a top end and a bottom end, and (ii) preferably also has lifting means connected thereto. A second sleeve assembly is mounted on the lower portion of the shaft, beneath the first sleeve assembly and above the probe, for relative axial slidable movement between an uppermost position and a lowermost position along the shaft.

The apparatus further comprises a plurality of retractable, gripping members pivotally mounted to the second sleeve assembly. Each gripping member has a top portion and a bottom portion. Each top portion is adapted to engage the inside surface of the internally accessible axially extending opening, and each bottom portion is adapted to slide along the bearing surface of the probe, such that when an upward force is applied to the shaft and the probe fixedly attached thereto, the bearing surface of the probe moves upwardly causing the bottom portion of the gripping members to move radially inwardly and the top portion of the gripping members to move radially outwardly for engaging contact with the inner surface of the opening.

Lastly, the apparatus comprises a plurality of cables. Each cable is attached at one end thereof to the top portion of a corresponding gripping member and at the other end thereof to the first sleeve assembly, such that when an upward force is applied to the first sleeve assembly lifting means, the first sleeve assembly and the second sleeve assembly move upwardly along the shaft from their lowermost to their uppermost positions, thereby causing the upper portion of the gripping members to move radially inwardly and out of engaging contact with the inner surface of the object, as the bottom portion of the gripping members move radially outwardly along the bearing surface.

Accordingly, it is an object of the present invention to provide a lifting apparatus, which will lift objects, particularly heavy objects, in the absence of a bias mechanism such as a spring to maintain the gripping members in position during engagement with the object.

Also, it is a further object of the present invention to provide a lifting apparatus, which will lift objects, particularly heavy objects, in the absence of a lever mechanism to lock the gripping members in position during engagement with the object.

It is an advantage of the present invention, that the apparatus, when in use, becomes more securely engaged with heavier objects than with relatively lighter objects.

Some of the objects of the invention having been stated above, other objects will become evident as the description proceeds, when taken in connection with the accompanying drawings as best described below.

DETAILED DESCRIPTION OF THE INVENTION AND FIGURES

The discussion below is of the preferred embodiment of the invention as illustrated in FIGS. 1—5. The same numerals are used to depict the same elements in the different FIGS. 1—5.

Figure 1:
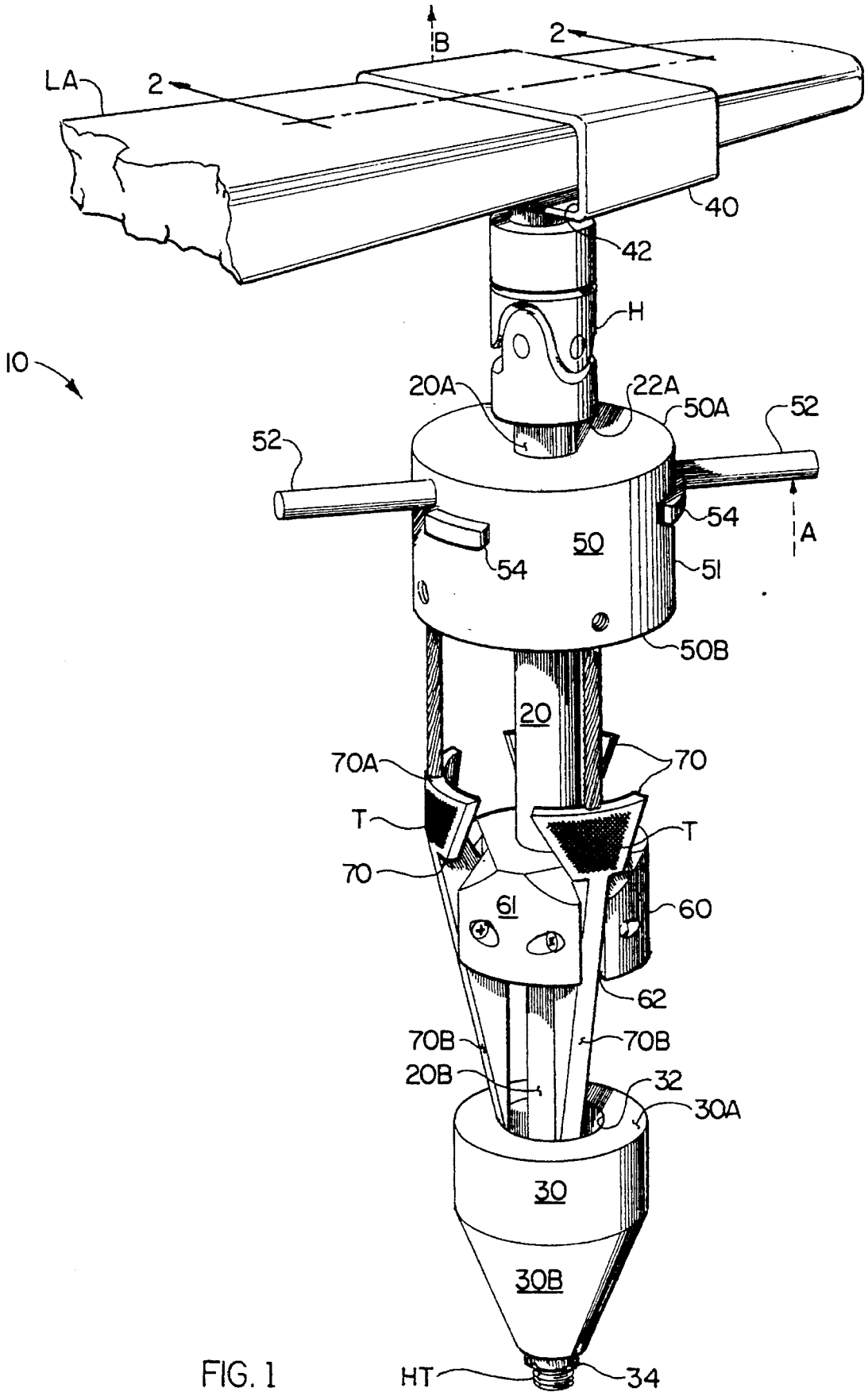
FIG. 1 is a perspective view of the lifting and reorienting apparatus of the present invention.
Figure 2:
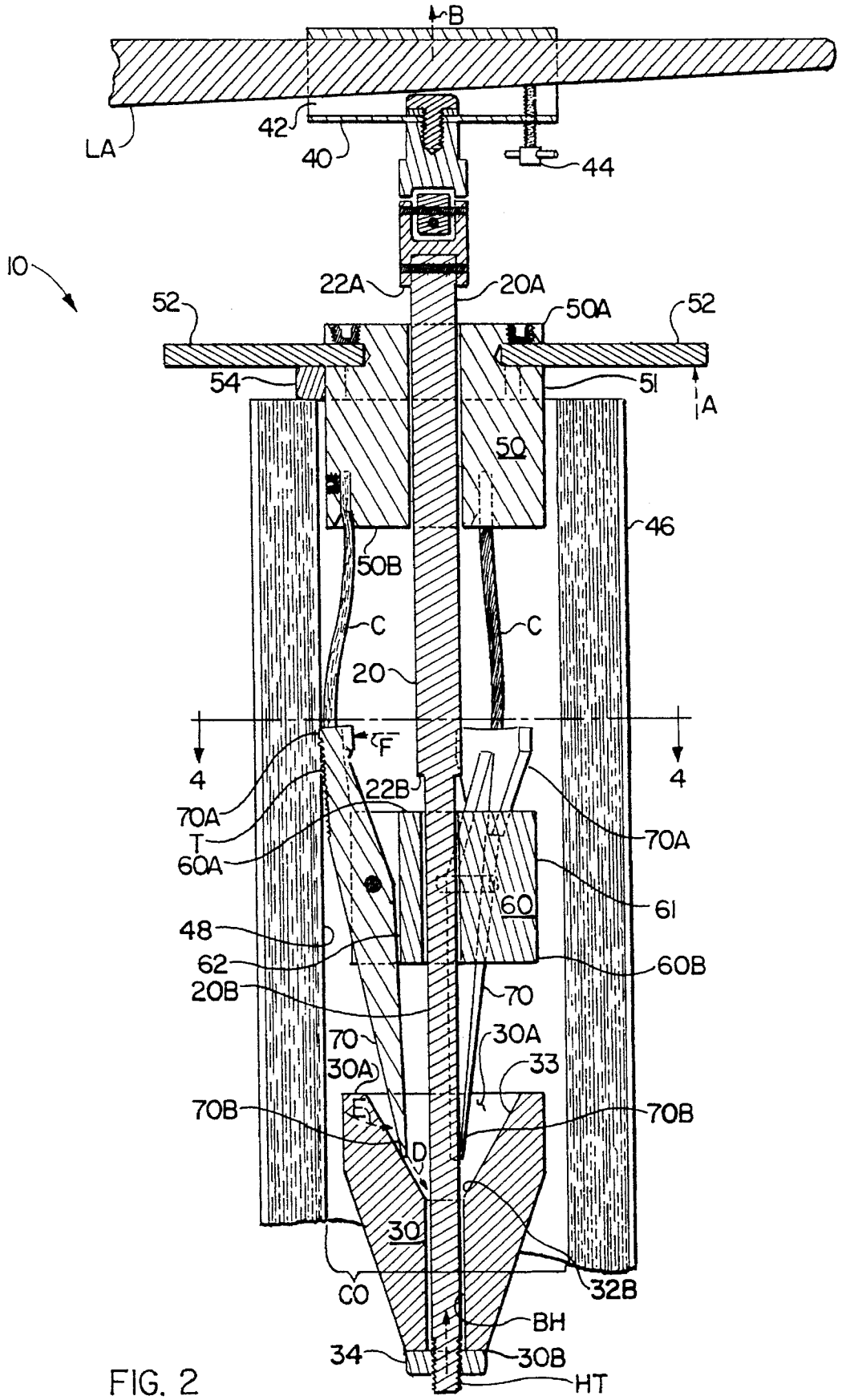
FIG. 2 is a vertical cross-sectional view of the lifting and reorienting apparatus of the present invention, in its extended position.
Figure 3:
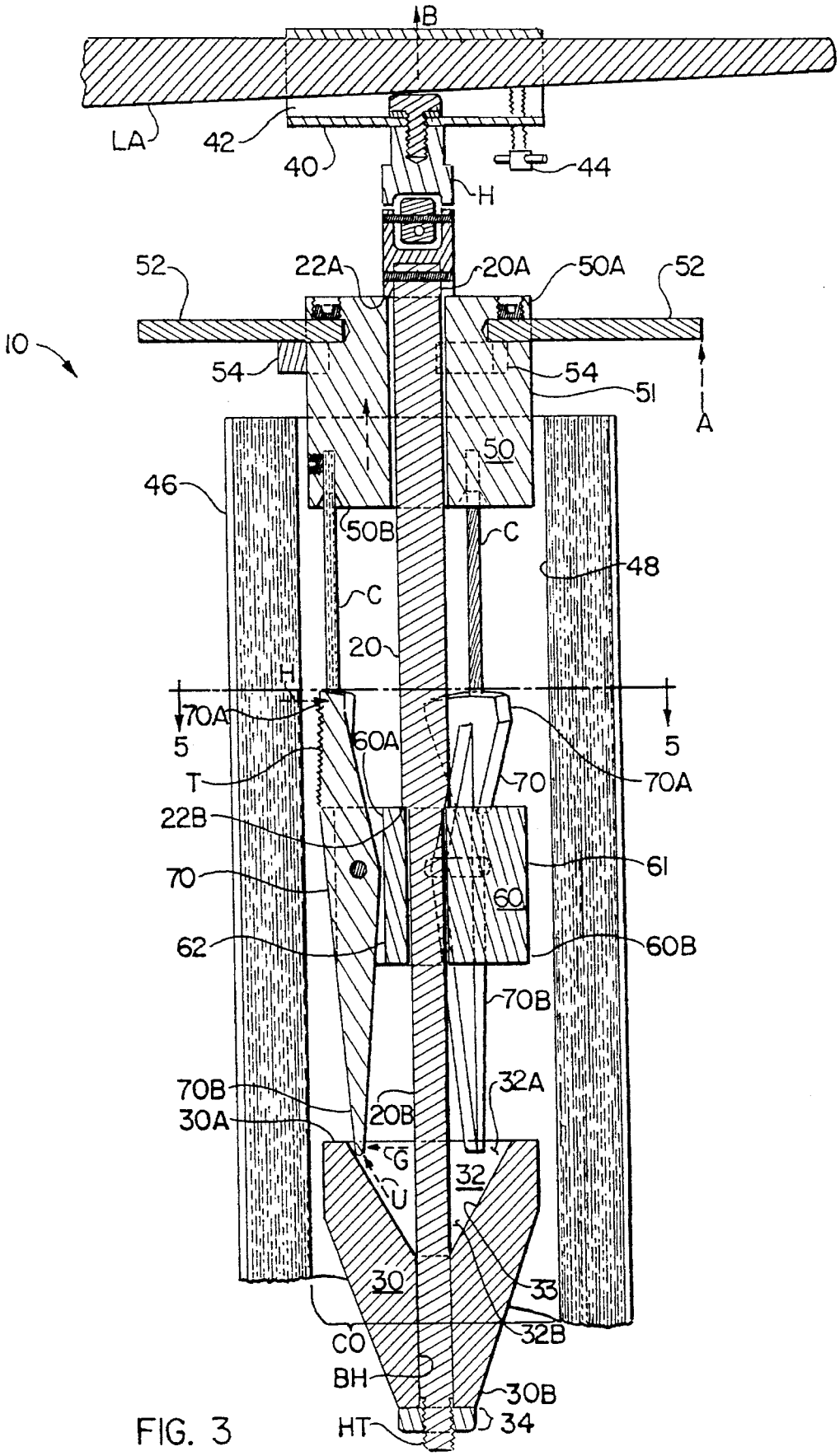
FIG. 3 is a vertical cross-sectional view of the lifting and reorienting apparatus of the present invention in its retracted position.

More particularly, illustrated in FIG. 1 is a perspective view of the inventive apparatus 10 for lifting and reorienting an object having an internally accessible axially extending opening. FIG. 2 is a vertical cross-sectional view of apparatus 10 in its extended position and FIG. 3 is a vertical cross-sectional view of apparatus 10 in its retracted position.

Apparatus 10 is provided with a generally elongated shaft 20, having an upper portion 20A and a lower portion 20B. Also, shaft 20 suitably has an upper shoulder 22A and a lower shoulder 22B, disposed in upper portion 20A and lower portion 20B, respectively. A generally tapered probe 30 is fixedly attached at lower portion 20B of shaft 20. Probe 30 has a top end 30A and a bottom end 30B and a center. Also, probe 30 is provided with a generally conical-shaped recess 32 within top end 30A of probe 30. Conical-shaped recess 32 has a top 32A and a bottom 32B. Also, recess 32 has a conical surface 33 that serves as a bearing surface of probe 30. Bearing surface 33 is described in more detail below.

Probe 30 should be rigidly attached to shaft 20, which may be accomplished by attaching probe 30 to shaft 20, such as by welding. However, in the preferred embodiment, probe 30 is provided with axial bore hole BH through the center thereof so that shaft 20 can extend through probe 30 and protrude past probe bottom end 30B. In that event, shaft 20 is provided with helical thread HT at lower portion 20B thereof, such that helical thread end HT protrudes past probe bottom end 30B and probe 30 is attached to shaft 20 by a suitable nut 34 screwed onto helical thread HT.

At upper portion 20A of shaft 20, apparatus 10 may be provided with lifting means 40, for instance, a suitable bar, rod, loop, bracket, or handle 40 secured to upper portion 20A. However, particularly when the object being lifted and reoriented with apparatus 10 is a light weight object, handle 40 would be unnecessary, and upper portion 20A of shaft 20 could simply be directly grasped, such as manually by hand (not shown) or by a clamp (not shown).

In the preferred embodiment, handle 40 is shown with aperture 42 suitably provided therein and also with optional wing nut 44. A lifting arm LA of a forklift truck (not shown) may be inserted into aperture 42 in order to place apparatus 10 in its extended position when it is located inside of a core and inside core surface 48, as illustrated in FIG. 2. Handle 40 may be suitably provided with wing nut 44, so that when wing nut 44 is tightened, it holds handle against lifting arm LA, thereby helping prevent apparatus 10 from accidently slipping off of lifting arm LA during movement of apparatus It is noted that although core 46 is simply shown as a paperboard tube having opening CO for ease of illustration, it is intended that core 46 represent an object having an internally accessible axially extending opening, including, but not limited to, a pipe, well casing, well tubing, bale of hay, roll of paper, roll of plastic, roll of fabric, roll of wire, roll of sheet metal, roll of newsprint, and the like. Thus, the object itself may have the opening or the object may have a tube therein providing the opening.

Also, shown in FIGS. 1, 2, and 3 is a first sleeve assembly 50, slidably mounted on shaft 20, and disposed near upper portion 20A of shaft 20, for relative axial slidable movement along shaft 20 between an uppermost and lowermost position. First sleeve assembly 50 has a top end 50A and a bottom end 50B and outside 51. Preferably, first sleeve assembly 50 is generally cylindrically shaped, and more preferably, is encircling shaft For removing apparatus 10 in the direction of arrow A from core 46 after the operation of lifting and reorienting an object is completed, first sleeve assembly 50 may be suitably provided with a first sleeve lifting means connected thereto, for instance, a suitable bar, rod, loop, or handle, and preferably two lifting rods 52 52, disposed at top end 50A, as illustrated in FIGS. 1–3. Rods 52, 52 also could serve to prevent apparatus 10 from sliding further down than desired into core 46.

Apparatus 10 is shown in its preferred embodiment with rods 52, 52, as well as with at least one shoulder 54, and preferably a plurality of three shoulders that rest on top of core 46 when apparatus 10 is inserted therein, thereby preventing apparatus 10 from sliding further down than desired into core 46, as can best be seen in FIG. 2.

It is noted that for ease of insertion and removal of apparatus 10 into and out of core opening CO of core 46, as described in more detail below, upper portion 20A is shown with a suitable hinge mechanism H disposed in shaft 20 above first sleeve assembly 50.

Apparatus 10 is also provided with a second sleeve assembly 60 slidably mounted on shaft 20. Second sleeve assembly 60 has a top end 60A and a bottom end 60B and outside 61. Preferably, second sleeve assembly 60 is generally cylindrically shaped, and more preferably, is encircling shaft 20. Second sleeve assembly 60 is disposed near lower portion 20B of shaft 20, beneath first sleeve assembly 50 and above tapered probe 30, for relative axial slidable movement between an uppermost and a lowermost position along shaft 20.

A plurality of retractable, gripping members 70, preferably three gripping members, are pivotally mounted to second sleeve assembly 60. Each gripping member 70 has a top portion 70A and a bottom portion 70B. Gripping members 70 preferably are dogs and more preferably are wedge-shaped. Each top portion 70A of each dog 70 is adapted to engage inside core surface 48, and thus engaging means such as teeth T may be suitably provided therefor.

Second sleeve assembly 60 preferably is further provided with recesses 62 for pivotal mounting of each dog 70 in a corresponding recess 62, and more preferably, since three dogs are preferred, there are three recesses, one for each of the three dogs. However, alternatively, dogs 70 simply could be mounted on outside 61 of second sleeve assembly As illustrated in FIG. 2, dogs 70 are caused to be in their radially extended position when an upward force in the direction of arrow B is applied to shaft 20, and therefore to probe 30 since it is fixedly attached to shaft 20, by lifting upwardly on upper portion 20A of shaft 20 in the direction of arrow B. Bottom portions 70B of dogs 70 preferably are tapered to facilitate sliding dogs 70 downwardly in the direction of arrow D along bearing surface 33 of conical-shaped recess 32, as dogs 70 are urged to their extended position by probe 30 as it moves upwardly. For instance, lifting of forklift truck arm LA in the direction of arrow B will cause bottom portions 70B of dogs 70 to move radially inwardly in the direction of arrow E and top portions 70A of dogs 70 to move radially outwardly in the direction of arrow F so that dogs 70 are in their extended position. When dogs 70 are in their extended position, each dog 70 is in position for engaging contact with the internal opening of the object, and teeth T engage core surface 48 of core 46.

A plurality of cables C, suitably flexible cables, are attached at one end thereof to a corresponding top portion 70A of each dog 70 and at the other end thereof to first sleeve assembly 50, preferably to bottom 50B thereof. Therefore, as can be seen in FIG. 3, when an upward force in the direction of arrow A is applied on lifting means 52 of first sleeve assembly 50, first sleeve assembly 50 and second sleeve assembly 60 move upwards along shaft 20 causing top portion 70A of each dog 70 to be pulled radially inwardly in the direction of arrow H and out of engaging contact with core surface 48 as bottom portion 70B of each dog 70 moves radially outwardly in the direction of arrow G along probe bearing surface 33. Consequently, dogs 70 are in their retracted position with their teeth T disengaged from core surface 48 and with bottom portion 70B of each dog 70 sliding up in the direction of arrow U along probe bearing surface 33 toward top 32A of conical recess 32. In other words, first sleeve assembly 50 and second sleeve assembly 60 move upwardly along shaft 20 from their lowermost to their uppermost positions, which is defined by shoulders 22A, 22B on shaft 20 and which first sleeve assembly 50 and second sleeve 60 assembly abut, respectively, at the top of their movement. In the absence of shoulders 22A, 22B, first sleeve assembly 50 instead would abut handle 40 when first sleeve assembly 50 and second sleeve 60 assembly were at their uppermost position.

Figure 5:
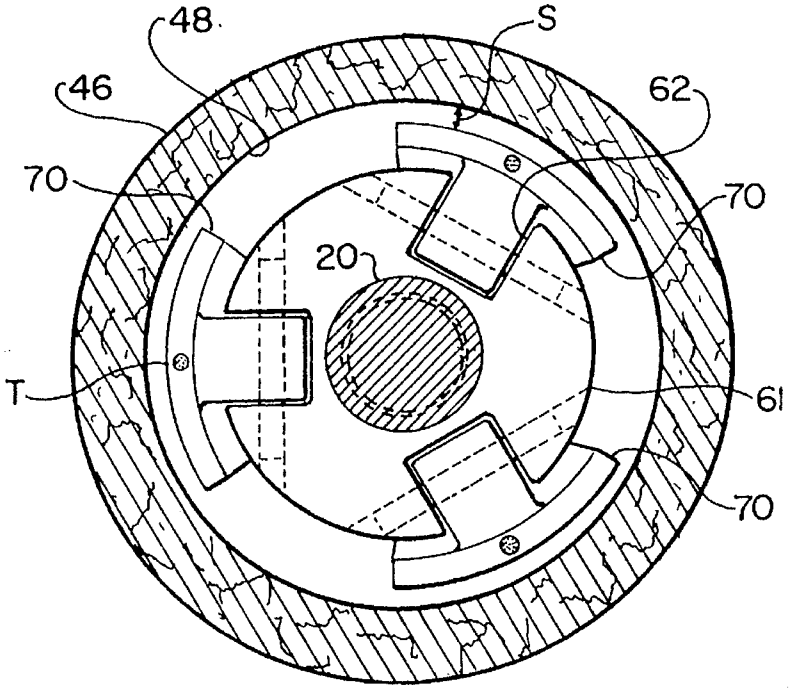
FIG. 5 is a view of the lifting and reorienting apparatus of the present invention taken along 5—5 of FIG. 3.
Figure 4:
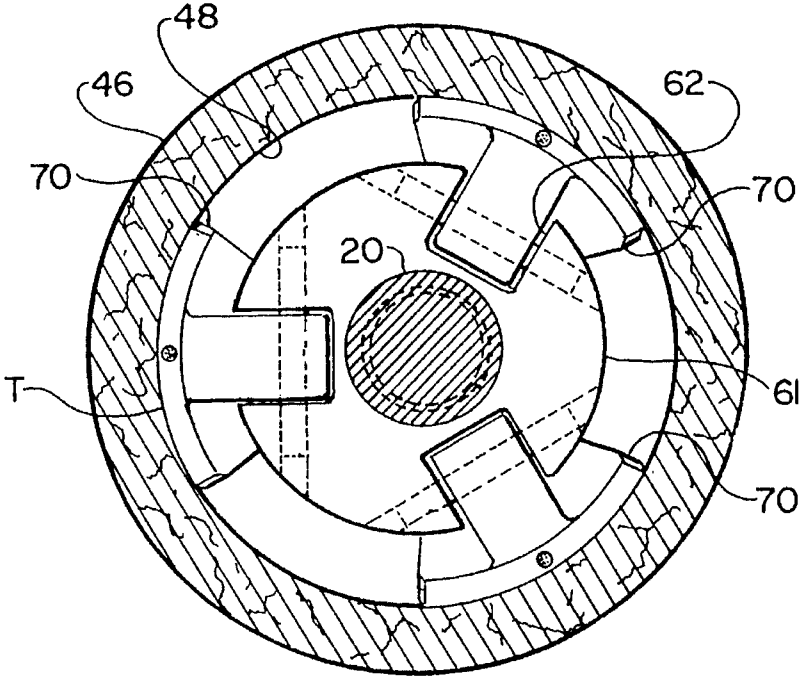
FIG. 4 is a view of the lifting and reorienting apparatus of the present invention taken along line 4—4 of FIG. 2.

Provided in FIGS. 4 and 5 are cross-sectional views taken above dogs 70 to help further illustrate the relationship of dogs 70 to core surface 48 when apparatus 10 is in its extended position and retracted position.

More particularly, FIG. 4 is a cross-sectional view of apparatus 10 taken along line 4—4 in FIG. 2, when apparatus 10, and therefore dogs 70 thereof, are in the extended position. As can be seen, each dog 70 is tight against inside core surface 48 so that teeth T of each dog 70 are in engagement with core surface 48.

It is noted that the more an upward force is applied to apparatus 10 in the direction of arrow B (see FIG. 2) and the heavier is the load supported by core 46, then the more securely teeth T will engage core surface 48. Although inventive apparatus 10 could be used for lifting very light objects, such as the liner cups for golf holes noted in the above-mentioned U.S. Pat. No. 4,577,899 to Hemingway, inventive apparatus 10 is especially suitable for lifting heavy objects, such as objects of a long ton (2240 pounds avoirdupois) or more in weight.

FIG. 5, on the other hand, is a cross-sectional view along line 5—5 of FIG. 3 illustrating apparatus 10, and therefore dogs 70 thereof, in the retracted position. This retracted position occurs from an upward force being applied to lifting means 52 in the direction of arrow A (see FIG. 3). As a result, dogs 70 are retracted away from core surface 48 of core 46, leaving an empty space S between teeth T and core surface 48, whereby apparatus 10 can be removed from core 46 when the lifting and reorienting is completed. For removal of apparatus 10 lifting means 52 may be manually lifted by the hands of a worker (not shown), or alternatively, it is also contemplated that a cable (not shown) could be attached to the lifting means and also attached to a lever (not shown) in the cabin of a forklift truck (not shown) so that the person operating the forklift truck could move the lever and raise lifting means 52, thereby lifting apparatus 10 out of core opening CO of core 46 for placement into the opening of the next core.

It is noted that apparatus 10 may be lowered into core opening CO of core 46 via lifting means 52. However, it is not necessary to lower apparatus 10 into core CO this way. As each dog 70 is retractable, top portions 70A thereof can be urged radially inwardly until a lifting force is applied to shaft 20 of apparatus 10. Hence, apparatus 10 may be lowered into core opening CO, for instance, by first placing forklift truck arm LA through handle 40 and then lowering forklift truck arm LA to lower apparatus 10 downwardly into core opening CO.

Apparatus 10 is suitably about 27 cm long, and about 8 cm in cross-sectional diameter, the cross-sectional diameter being a little larger when dogs 70 are extended and a little smaller when dogs 70 are retracted. Of course, the apparatus size will vary with the size of the opening in the core of the object that it is desired to move with apparatus be, since the cross-sectional diameter when dogs 70 are in extended position must be large enough to engage teeth T with the internal surface of the core, yet the cross-sectional diameter when dogs 70 are in retracted position must be small enough to allow apparatus 10 to be slidably moved into and out of the core opening. The desired size of apparatus 10 can be readily determined by the person of ordinary skill in the art.

It will be understood that various details of the invention may be changed without departing from the scope of the invention. Furthermore, the foregoing description is for the purpose of illustration only, and not for the purpose of limitation — the invention being defined by the claims.

What is claimed is:

1. An apparatus for lifting and reorienting an object having an internally accessible axially extending opening defining an inner surface thereof, said apparatus comprising:

(A) a generally elongated shaft having an upper portion and a lower portion;

(B) a generally tapered probe fixedly attached at the lower end of the shaft, the probe having (i) a top end, a bottom end, and a center, and (ii) a generally conical-shaped recess disposed within the top end of the probe, with the conical recess having a top and a bottom, and having the conical surface thereof serving as a bearing surface;

(C) a first sleeve assembly mounted on the upper portion of the shaft, for relative axial slidable movement between an uppermost position and a lowermost position along the shaft, the first sleeve assembly having a top end and a bottom end;

(D) a second sleeve assembly mounted on the lower portion of the shaft, beneath the first sleeve assembly and above the probe, for relative axial slidable movement between an uppermost position and a lowermost position along the shaft;

(E) a plurality of retractable, gripping members pivotally mounted to the second sleeve assembly, each gripping member having a top portion and a bottom portion, each top portion being adapted to engage the inner surface of the internally accessible axially extending opening, and each bottom portion being adapted to slide along the bearing surface of the probe, such that when an upward force is applied to the shaft and the probe fixedly attached thereto, the bearing surface of the probe moves upwardly causing the bottom portion of the gripping members to move radially inwardly and the top portion of the gripping members to move radially outwardly for engaging contact with the inner surface of the opening; and (F) a plurality of cables, each cable being attached at one end thereof to the top portion of a corresponding gripping member and at the other end thereof to the first sleeve assembly, such that when an upward force is applied to the first sleeve assembly, the first sleeve assembly and the second sleeve assembly move upwardly along the shaft from their lowermost to their uppermost positions, thereby causing the top portion of the gripping members to move radially inwardly and out of engaging contact with the inner surface of the object, as the bottom portion of the gripping members move radially outwardly along the bearing surface.

2. The apparatus of claim 1, wherein the shaft includes an upper shoulder and a lower shoulder, which the first sleeve assembly and the second sleeve assembly abut, respectively, when at their uppermost position.

3. The apparatus of claim 1, including an apparatus lifting means secured to the upper end of the shaft above the first sleeve assembly.

4. The apparatus of claim 3, further including a hinge disposed in the shaft between the apparatus lifting means and the first sleeve assembly.

5. The apparatus of claim 1, wherein the shaft is provided with a helical thread at the shaft lower end and the probe is provided with an axial bore hole through the center thereof so that the shaft extends through the probe and the helical thread end of the shaft protrudes past the probe bottom end.

6. The apparatus of claim 5, wherein the probe is attached at the lower end of the shaft by a nut screwed onto the helical thread.

7. The apparatus of claim 1, wherein first sleeve assembly lifting means is associated with the first sleeve assembly.

8. The apparatus of claim 1, wherein the first sleeve assembly includes at least one shoulder, which will, when the apparatus is inserted into an internally accessible axially extending opening of an object, rest on the object, thereby preventing the apparatus from sliding further down than desired into the axially extending opening.

9. The apparatus of claim 1, wherein the second sleeve assembly is provided with a plurality of recesses, and each gripping member is pivotally mounted in a corresponding recess to the second sleeve assembly.

10. The apparatus of claim 1, wherein the plurality of gripping members comprises three gripping members.

11. An apparatus for lifting and reorienting an object having an internally accessible axially extending opening, said apparatus comprising:

(A) a generally elongated shaft having an upper portion and a lower portion;

(B) a generally tapered probe fixedly attached at the lower end of the shaft, the probe having (i) a top end, a bottom end, and a center, and (ii) a generally conical-shaped recess disposed within the top end of the probe, with the conical recess having a top and a bottom, and having a conical surface with the conical surface thereof serving as a bearing surface;

(C) a first sleeve assembly disposed at the upper end of the shaft, for relative axial slidable movement along the shaft, the first sleeve assembly having a top end and a bottom end;

(D) a second sleeve assembly disposed at the lower end of the shaft, beneath the first sleeve assembly and above the probe, for relative axial slidable movement along the shaft;

(E) a plurality of retractable, gripping members pivotally attached to the second sleeve assembly, each gripping member having a top portion and a bottom portion, each top portion being provided with engaging means, such that when an upward force is applied to the shaft and the probe fixedly attached thereto, the bearing surface of the probe moves upward, thereby causing the bottom portion of each gripping member to move radially inwardly and slide downward along the bearing surface of the probe toward the bottom of the conical-shaped recess and causing the top portion of each gripping member to move radially outwardly, so that the gripping members are in their extended position for engagement of the engaging means with the object via the internally accessible opening of the object; and (F) a plurality of cables, each cable being attached at one end thereof to the top portion of a corresponding gripping member and at the other end thereof to the first sleeve assembly, such that when an upward force is applied to the first sleeve assembly, the first sleeve assembly and the second sleeve assembly move upwards along the shaft, thereby causing the bottom portion of each gripping member to move radially outwardly and slide upward along the bearing surface toward the top of the conical-shaped recess and causing the top portion of each gripping member to move radially inwardly, so that the gripping members are in their retracted position for disengagement of the engaging means from the internally accessible opening of the object.

* * * * *